United States Patent [19]

Fischer

[11] 4,224,758

[45] Sep. 30, 1980

[54] STRUCTURAL ELEMENT OF AN ASSEMBLY KIT

[76] Inventor: Artur Fischer, D-7244 Waldachtal, Tumlingen, Fed. Rep. of Germany

[21] Appl. No.: 9,691

[22] Filed: Feb. 5, 1979

[30] Foreign Application Priority Data

Feb. 22, 1978 [DE] Fed. Rep. of Germany ..... 2807429

[51] Int. Cl.[3] ..... A63H 33/10

[52] U.S. Cl. ..... 46/23

[58] Field of Search ..... 46/23, 26, 17

[56] References Cited

U.S. PATENT DOCUMENTS

| | | | |
|---|---|---|---|
| 1,763,302 | 6/1930 | Gilbert | 46/23 |
| 3,484,983 | 12/1969 | Fischer | 46/23 |
| 3,516,194 | 6/1970 | Schmidlin | 46/23 X |
| 4,050,184 | 9/1977 | Chiari | 46/23 X |

FOREIGN PATENT DOCUMENTS

| | | | |
|---|---|---|---|
| 2620817 | 11/1977 | Fed. Rep. of Germany | 46/23 |
| 1185407 | 3/1970 | United Kingdom | 46/17 |
| 1392909 | 5/1975 | United Kingdom | 46/23 |

*Primary Examiner*—F. Barry Shay
*Attorney, Agent, or Firm*—Michael J. Striker

[57] ABSTRACT

A structural element of an assembly kit, for mounting a motor to a supporting plate having holes, has a body portion with an inner hollow for receiving a motor, fixing elements on the body portion for fixing the motor to the latter, a plurality of projections on the body portion which extend through the holes of the plate and one of which has means for arresting the body portion to the plate, and a plurality of connecting elements on the body portion which are parallel to one another and are arranged to connect a further structural element to the body portion. The one projection may have such a length that it extends outwardly beyond the plate and has an undercut outer portion which is engageable in an undercut hole of a tightening member. The body portion may be provided with a transmission so that when the motor is inserted into the hollow of the body portion, it is connected with the transmission to form a drive unit.

9 Claims, 5 Drawing Figures

STRUCTURAL ELEMENT OF AN ASSEMBLY KIT

BACKGROUND OF THE INVENTION

The present invention relates to a structural element of a toy assembly kit, and more particularly to a structural element having undercut grooves and/or projections for fixing a motor and mounting the latter on a structural plate provided with holes.

Structural plates of toy assembly kits, having interengageable undercut projections and grooves have been proposed in the art. Such structural plates have undercut slots which extend from the marginal edges toward the central regions of the plates. On the grounds of stability, the slots must not extend up to the central region of the structural plate, whereby further structural elements cannot be connected with the structural plate in the central region thereof. This is especially disadvantageous for assembling motor-driven toy vehicles, since in such vehicles the drive unit, because of the vehicle wheels, must be mounted in the center of the structural plate. It is therefore necessary in the known assembly kits to provide an expensive construction in which additional connecting means are arranged on the edges of structural plate for supporting the drive unit.

It is also difficult to assemble toy train models which must have a certain wheel track determined by the unit, on the one hand, and a small distance between the wheel axles for running over a curved path, on the other hand. Because of the length of the drive unit including the motor and the transmission, only a great distance between the wheel axles can be provided in the known assembly kits.

SUMMARY OF THE INVENTION

Accordingly, it is an object of the present invention to provide a structural element of an assembly kit, which avoids the disadvantages of the prior art.

More particularly, it is an object of the present invention to provide a structural element with the use of which a drive unit can be mounted in the central region of a structural or supporting plate, and a toy vehicle can be assembled with a small distance between the wheels axles.

In keeping with these objects and with others which will become apparent hereinafter, one feature of the present invention resides, briefly stated, in a structural element which has a body portion with a hollow for receiving a motor therein, means in the body portion for fixing a motor to the latter, a plurality of projections on the body portion and extending through holes of a structural plate one of which projections extends outwardly beyond the supporting plate and has means for arresting the body portion to the plate, and a plurality of connecting means in the body portion and located parallel to one another and arranged to connect further structural elements to the body portion.

In such a construction, the projections of the body portion engage in the holes of the structural plate, the holes being formed in the central region of the structural plate. Thereby, a reliable arresting against rotation is attained. Then the motor is inserted into the hollow of the structural element and fixed therein by the fixing means. The connecting means which are further formed in the structural element, provide for further mounting possibilties. For instance, axle holders on which wheels can be mounted may be connected to the body portion by the connecting means in the region of the drive unit.

Since several such connecting means are formed on the body portion of the structural element, the distance between the axles can be easily adjusted. Furthermore, several wheel pairs or other structural elements, such as current collectors for assembling a toy locomotive, can be connected with the body portion of the structural element.

The fixing means of the body portion for fixing the motor to the latter may include undercut projections and/or grooves provided in the body portion and engageable with the undercut grooves and/or projections provided on the motor. The connecting elements of the body portion may preferably be formed in side walls, whereas the projections may be provided on a lower wall of the body portion.

In accordance with a further feature of the present invention, the body portion of the structural element may be tightened to the structural plate by an outer end portion of one of the projections which has an undercut shape. Such an outer end portion may be provided with a slot and engages in an undercut groove of a tightening member. Two such slots may be formed in the outer end portion of the projection so that the latter is substantially resiliently yieldable in a direction which is transverse to the direction of elongation of the projection.

Finally, in accordance with a further feature of the present invention, a transmission may be mounted on the body portion so that when the motor is inserted in the hollow of the body portion, the motor couples with the transmission so as to form together a drive unit. This construction is especially advantageous when the total length of the drive unit, including the motor and the transmission, must be shortened. In this case, the structural element is so formed that the side walls, of the structural element to which the further structural elements can be connected, including the built-in transmission, are located underneath the motor. Such a construction makes also possible a very small wheel track since the width of the structural element can be smaller than the width of the motor.

The novel features which are considered as characteristic for the invention are set forth in particular in the appenedd claims. The invention itself, however, both as to its construction and its method of operation, together with additional objects and advantages thereof will be best understood from the following description of specific embodiments when read in connection with the accompanying drawings.

DESCRIPTION OF PREFERRED EMBODIMENTS

Figure 1:
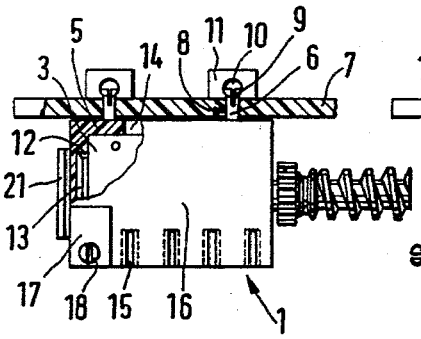
FIG. 1 is a view showing a structural element of a toy assembly kit, connected to a central region of a supporting plate.
Figure 2:
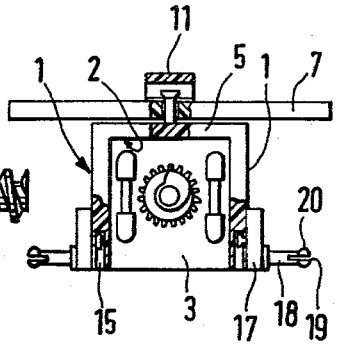
FIG. 2 is a side view of the structural element shown in FIG. 1.

A structural element of a toy assembly kit in accordance with one embodiment of the present invention is shown in FIGS. 1 and 2 and identified by reference numeral 1. It has a hollow 2 for receiving a motor 3 therein. A bottom wall 5 of the structural element 1 is provided with projections 6.

A structural or supporting plate 7 on which the motor 3 is to be mounted, has holes in the central region thereof, the holes being identified by reference numeral 8 and spaced from one another in two transverse directions. The projections 6 of the structural element 1 engage in the holes 8 of the supporting plate 7. Two of the projections 6 each has an outer end portion extending outwardly beyond the plate 7. Each outer end portion has a slot 9 extending in a direction of elongation thereof and rendering the outer end portion deformable in a direction transverse to the direction of elongation.

Elements 11 are utilized for tightening the structural element 1 to the supporting plate 7. Each of the members 11 has an undercut groove 10 in which the outer end portion of a respective one of the projections 6 engages. The outer end portions of the projections 6 have an undercut shape. When the outer end portions of the projections 6 of the structural element 1 enagage in the undercut grooves of the member 11, the structural element 1 is tightened to the structural plate 7.

After this, the motor 3 is inserted into the hollow 2 of the structural element 1. The latter has an undercut groove 12 formed in the region of the hollow 2, in which groove 12 an undercut projection 13 of the motor engages. Thereby, the motor 3 is fixed to the structural element 1. In order to facilitate the withdrawal of the motor 3 from the hollow 2 of the structural element 1, a recess 14 is formed in the bottom wall 5 of the structural element 1.

For assembling a toy vehicle, for example, a toy train, a transmission must be provided and connected with the motor 3. Such a transmission must have axles for mounting driven wheels thereon. The wheels mountable on the axles are known per se in the art, and for this reason are not shown in the drawing. Side walls 16 of the structural element 1 are provided with a plurality of undercut grooves 15 which are spaced from and parallel to one another. An axle holder 17 can be mounted in the grooves 15, the axle holder provided with axle end portions 18. Each of the axle end portions 18 has a slot 19 and a bead 20 for shifting wheels onto and fixing the same on the axle end portions. Several such wheel holders 17 can be inserted into the grooves 15. Since the side walls of the structural element 1 are provided with several such connecting grooves 15, the axle holders 17 can be inserted into various connecting grooves 15 whereby the distance between the axles can be varied. Further assemblying possibilities are attained by provision of undercut connecting projections 21 on one side wall of the structural element 1.

Figure 3:
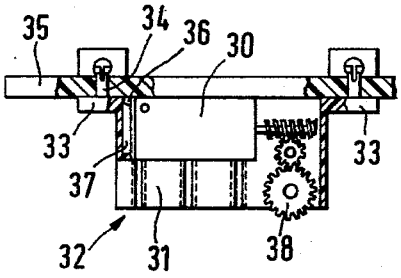
FIG. 3 is a view showing the structural element provided with a transmission which is located below a motor of a toy drive unit.
Figure 4:
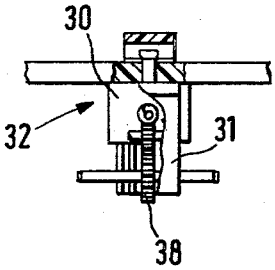
FIG. 4 is a side view of the structural element shown in FIG. 3.

As shown in FIGS. 3 and 4 depicting another embodiment of the present invention, therein is a possibility to utilize a motor which has a width exceeding the width of the wheel track required for the toy vehicle to be assembled. In accordance with this embodiment, a motor 30 rests on side wall 31 of a structural element 32. The latter is mounted on a structural plate 35 by projections 34 arranged on end flanges 33. The motor 30 is additionally held by a connecting projection 37 which engages in a respective groove 36 of the structural element 32.

Figure 5:
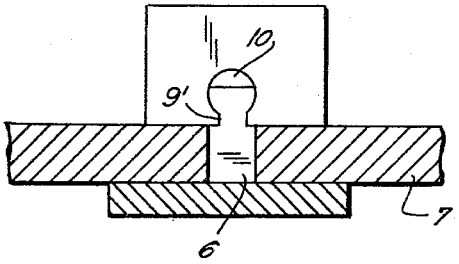
FIG. 5 is an enlarged view showing means for connecting the structural element with the supporting plate.

In order to shorten the total length of the drive unit which includes the motor and the transmission, the structural element 32 is provided with a built-in transmission 38. When the motor 30 is mounted in the structural element 32, it couples with the transmission 38. It can be seen that the portion of the side wall provided with the connecting slots and the transmission are located underneath the motor 30. FIG. 5 shows that the projections 6 of the structural element 1 for connecting the latter to the supporting plate 7 may have no slots. The end portion of each projection 6 has in this case, two indentations or grooves 9' which are formed at both sides of each end portion and define the undercut shape of the latter. On the other hand, each structural member 11 has two projections or lips which define the undercut shape of the groove 10 and are engageable in the indentations 9' of the end portion of the projections 6 of the structural element 1. Thereby, each of the structural members 11 can be shifted over the end portion of the respective projection 6 and thereafter held on the latter in this position.

It will be understood that each of the elements described above, or two or more together, may also find a useful application in other types of constructions differing from the types described above.

While the invention has been illustrated and described as embodied in a structural element for an assembly kit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims:

1. A structural element of an assembly kit for mounting to a supporting plate provided with holes each having a predetermined transverse dimension, a drive unit including a motor and a transmission located adjacent to one another in a first direction, and a plurality of wheel axles spaced from each other in the first direction, the structural element comprising a body portion having an inner hollow arranged for receiving a motor therein, and side walls spaced from one another in a second direction which is transverse to the first direction, said body portion having an inner surface facing toward said inner hollow and an outer surface facing away from the same; a plurality of projections on said outer surface of said body portion and each arranged to extend through a respective one of the holes of the supporting plate, at least one of said projections having an outer end portion extending outwardly beyond the supporting plate said outer end portion having a transverse dimension exceeding said predetermined dimension; a tightening member located outwardly beyond the supporting plate and engaging said outer portion of said one projection so as to tighten said body portion to the supporting plate; and at least three connecting elements on said outer surface in each of said side walls of said body portion, extending parallel to each other and being spaced from each other in said first direction so as to connect wheel axles to said body portion at locations spaced in said first direction, whereby the drive unit can be connected to the supporting plate even in the central region thereof, and toy vehicles may be constructed with different distances between axles, including a distance which is smaller than the length of the drive unit.

2. A structural element as defined in claim 1, wherein the motor has a first formation; and further comprising fixing means for fixing the motor to said body portion and including a second formation which is engageable with the first formation of the motor, one of said formations is an undercut groove whereas the other formation is an undercut projection engageable in said undercut groove.

3. A structural element as defined in claim 1, wherein said body portion further having a lower wall, said projections being provided on said lower wall of said body portion.

4. A structural element as defined in claim 1, wherein said outer end portion of said one projection has an undercut cross section tightening member having an undercut groove in which said undercut outer end portion of said one projection is engageable.

5. A structural element as defined in claim 4, wherein said one projection is elongated, said outer end portion of said one projection being provided with a slot extending in the direction of elongation and rendering said outer end portion resiliently deformable in a direction transverse to the direction of elongation.

6. A structural element as defined in claim 4, wherein said one projection is elongated, said outer end portion of said one projection having two indentations located opposite to and spaced from one another in a direction transverse to the direction of elongation of said one projection, said tightening member having portions engageable in said indentations.

7. A structural element as defined in claim 1; and further comprising a transmission mounted on said body portion so that when the motor is received in said hollow of said body portion said transmission is connected with the motor so as to form together the drive unit.

8. A structural element as defined in claim 1, wherein each of said connecting elements includes an undercut connecting groove.

9. A structural element as defined in claim 8, wherein said connecting elements further includes a wheel holding member having a first undercut portion engageable in a respective one of said undercut connecting grooves and a second portion arranged to support a wheel.

* * * * *